United States Patent [19]

Sutherland et al.

[11] Patent Number: 4,708,284

[45] Date of Patent: Nov. 24, 1987

[54] LOCK ARRANGEMENT

[75] Inventors: Robert L. Sutherland, Campbell Hall, N.Y.; William M. Brown, Darien, Conn.

[73] Assignee: Federal Paper Board Co., Inc., Montvale, N.J.

[21] Appl. No.: 828,547

[22] Filed: Feb. 12, 1986

[51] Int. Cl.[4] ..... B65D 5/04

[52] U.S. Cl. ..... 229/48 R; 206/140; 206/427; 229/40; 493/137

[58] Field of Search ..... 229/40, 48 R; 206/427, 206/434, 140; 493/137–139

[56] References Cited

U.S. PATENT DOCUMENTS

| | | | |
|---|---|---|---|
| 3,381,881 | 5/1968 | Ganz et al. | 206/140 |
| 3,432,029 | 3/1969 | Brown | 206/140 |
| 3,670,950 | 6/1972 | Rossi | 206/140 |
| 3,705,681 | 12/1972 | Rossi et al. | 229/40 |
| 3,767,042 | 10/1973 | Ganz | 229/40 |
| 3,797,729 | 3/1974 | Holmes | 229/40 |
| 3,986,658 | 10/1976 | Arneson et al. | 229/40 |
| 4,200,220 | 4/1980 | Ganz | 206/140 |
| 4,526,316 | 7/1985 | Sutherland | 229/40 |
| 4,611,754 | 9/1986 | Sutherland | 206/434 |

FOREIGN PATENT DOCUMENTS

| | | | |
|---|---|---|---|
| 2418158 | 10/1979 | France | 229/48 R |

*Primary Examiner*—Joseph Man-Fu Moy
*Assistant Examiner*—Gary E. Elkins
*Attorney, Agent, or Firm*—Charles E. Brown

[57] ABSTRACT

This relates to a lock arrangement particularly adapted for use in locking together closure panels of paper board cartons and the like. The lock arrangement utilizes a conventional basic type of lock including a primary locking tab and a secondary locking tab. The primary locking tab engages in a cutout having as part of its boundary a straight line primary locking shoulder. The new feature of the lock arrangement is an arrangement for receiving the secondary locking tab. This arrangement is in the form of a cut line which will define an opening through the associated closure panel and also define a secondary locking ear for engagement beyond a prong on the secondary locking tab. The closure panel in which the cutout and the cut line are formed is provided adjacent the cut line either with an opening or a hinged locking flap with there being between the cutout and either the opening or the locking flap a narrow strap. When a nose of the secondary locking tab engages the panel between the narrow strap and the cut line, the panel is locally bowed through a twisting of the narrow strap facilitating the opening of the panel along the cut line so as to automatically receive the nose of the secondary locking tab.

23 Claims, 23 Drawing Figures

FIG. 16
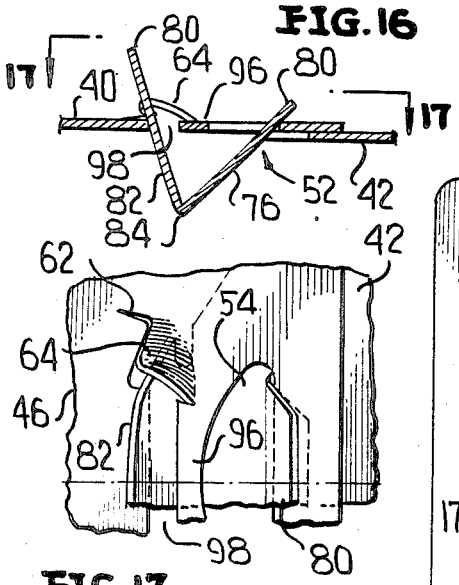
FIG. 17
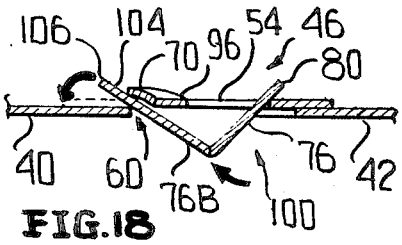
FIG. 18
FIG. 19
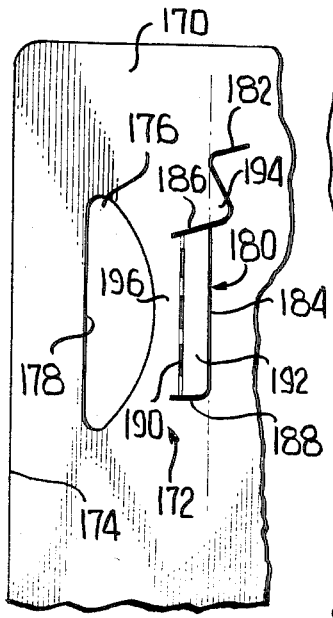
FIG. 20
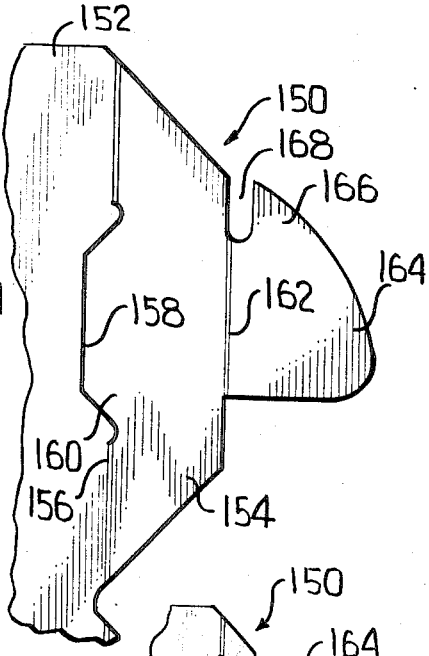
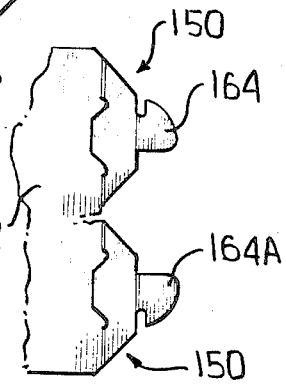
FIG. 21
FIG. 22
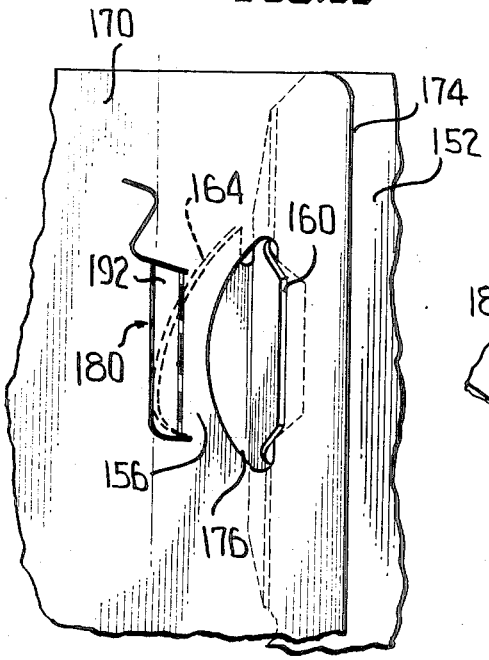
FIG. 23
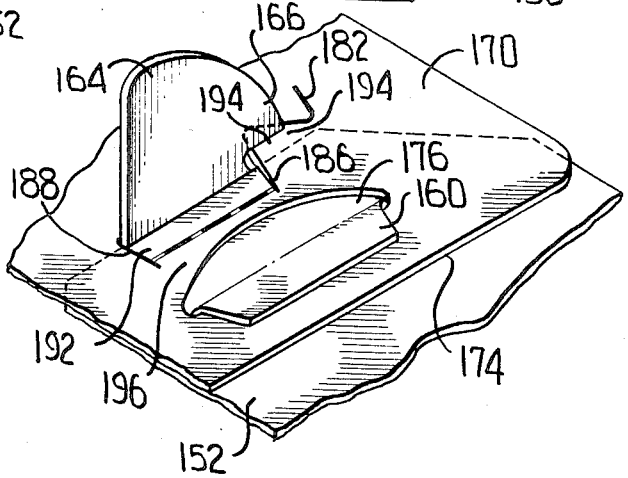

LOCK ARRANGEMENT

This invention relates to new and useful improvements in cartons, and more particularly to a lock arrangement for locking together closure panels of cartons and the like.

There has been previously developed lock arrangements wherein a specific cut line has been provided to define a locking ear behind which a prong of a locking tab may be engaged. Such a lock arrangement is disclosed in U.S. Pat. No. 4,526,316, granted July 2, 1985, and in U.S. application Ser. No. 726,984, filed Apr. 25, 1985, now U.S. Pat. No. 4,611,754 granted Sept. 16, 1986. However, these prior lock arrangements have been limited to locks where the tabs in question have been positioned immediately adjacent a side wall of a carton.

It has now been found that the general principles of the prior lock arrangements can be beneficially utilized in conjunction with a secondary locking tab of a lock arrangement wherein two closure panels are locked together generally at the center of a carton wall and that such lock arangement can be utilized in conjunction with existing automatic machinery for closing cartons after the cartons have been filled with containers for which they are designed.

A principle feature of this lock arrangement is that in order to receive a primary locking tab, a carton panel is provided with a cutout which defines a primary locking shoulder and adjacent the cutout and in alignment therewith there is formed a cut line which defines at least one secondary locking ear with the cut line being openable to receive a secondary locking tab. In order to effect the opening of the carton panel along the cut line, there is positioned immediately adjacent at least a straight line portion of the cut line and between the cut line and the cutout opening means. The opening means may be in the form of a flap which is hinged to the carton panel remote from the cut line with the flap being deflectable by the secondary locking tab or there may simply be an opening. In the forming of either the opening or the flap, there is formed between the opening or the flap and the cutout a narrow strap. When the nose of the secondary locking tab is engaged with either the flap or with side edges of the opening, the panel, including the strap, is free to bow or arch with the automatic opening of the panel along the straight portion of the cut line to receive the secondary locking tab.

It also has been found with certain secondary locking tabs which remain generally normal to the panel in which the cut line is formed that the flap, which is resiliently hinged, engages the secondary locking tab and forces the secondary locking tab into a position wherein a transversely projecting prong thereof will be positively moved into overlapping relation to an associated secondary locking ear defined by the cut line.

The opening means which permits the nose of the secondary locking tab to automatically open the panel along the cut line permits the relatively weak secondary locking tab when the carton is formed of low caliber board to have sufficient stiffness to open the panel along the cut line.

The secondary locking tab may be of several configurations. First of all, while the secondary locking tab preferably may have the configuration of an arrow head, it is to be understood that the secondary locking tab may have but a single prong. Additionally, the secondary locking tab, which has a narrow throat portion defined by the one or more prongs, may either be hinged to the body of a locking flap at its throat or the secondary locking tab may be rigid with a portion of the locking flap and the locking flap having an intermediate hinge line. In the first described case, the secondary locking tab will extend through the panel generally at right angles to the panel, whereas in the second case, the secondary locking tab may extend generally parallel to the panel through which it passes.

It has been found that not only can the modified lock be engaged utilizing conventional equipment, but also by utilizing the cut line in lieu of the normal opening for receiving the secondary tab, a more secure lock is possible.

With the above and other objects in view that will hereinafter appear, the nature of the invention will be more clearly understood by reference to the following detailed description, the appended claims, and the several views illustrated in the accompanying drawings.

FIG. 16 is a fragmentary sectional view similar to FIG. 10 but wherein there is a cutout or opening adjacent the cut line as shown in FIG. 5.

FIG. 17 is fragmentary plan view showing the relationship of the secondary locking tab and the inner closure panel as viewed along the line 17—17 of FIG. 16.

FIG. 18 is a fragmentary sectional view similar to FIG. 10 but showing the secondary locking tab arrangement of FIG. 7.

FIG. 19 is a plan view of a corner of a modified form of locking tab receiving opening arrangement.

FIG. 20 is a plan view of an opposite corner of a blank to be associated with the corner shown in FIG. 19 and shows the details of still another form of locking tab arrangement.

FIG. 21 is a fragmentary plan view of one edge of closure panel incorporating the locking tab arrangement of FIG. 20 and showing the utilization of left and right hand secondary locking tabs.

FIG. 22 is a fragmentary plan view similar to FIG. 8 and shows the locking tab arrangement of FIG. 20 engaged with the closure panel of FIG. 19 at a point of initial engagement of the secondary locking tab.

FIG. 23 is an enlarged fragmentary perspective view showing the relationship of the overlapped panels of FIGS. 19 and 20 and the interlocking together of such panels.

Figure 1:
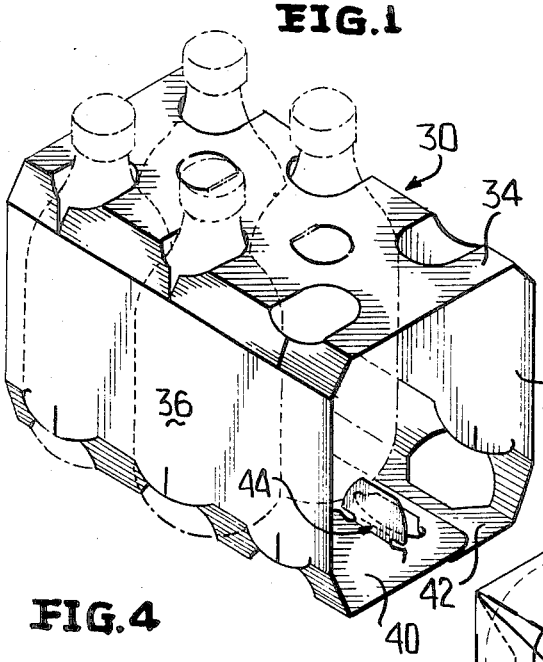
FIG. 1 is a perspective view of a carton of the wrap around type wherein bottom closure panels are locked together utilizing the lock arrangement of this invention.

Referring now to the drawings in detail, reference is first made to FIG. 1 wherein there is illustrated a carton of the wrap around type, the carton being generally identified by the numeral 30. The illustrated carton is formed of a one-piece blank identified by the numeral 32 and illustrated in FIG. 3. Basically, the carton 30 includes a top panel 34, side panels 36, 38, an inner closure panel 40 and an outer closure panel 42. This invention relates in particular to the lock arrangement between the closure panels 40, 42, the lock arrangement being generally identified by the numeral 44.

At this time it is pointed out that although the carton 30 is illustrated as having therein six bottles, it is to be understood that the number of bottles may be varied and further the carton may be modified so as to carry cans as opposed to bottles.

Figure 3:
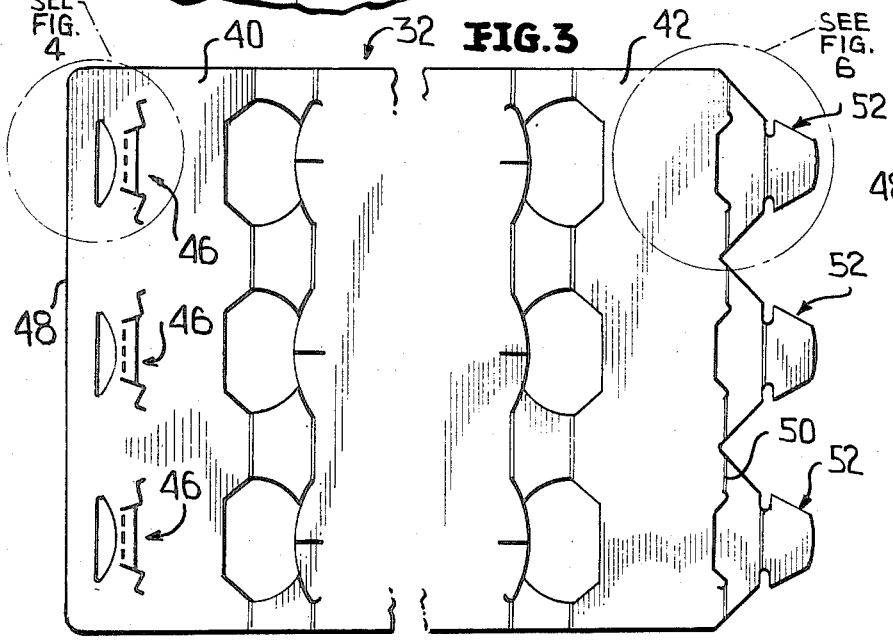
FIG. 3 is a plan view of a blank with central portions broken away for forming the carton of FIG. 1.

Referring next to FIG. 3, it will be seen that the blank 32 is divided into a plurality of panels and have at the opposite ends thereof the inner closure panel 40 and the outer closure panel 42. As will be more specifically described in detail hereinafter, the inner closure panel 40 is provided with a plurality of locking tab receiving arrangements generally identified by the numeral 46 and terminates in a terminal edge 48.

The outer closure panel 42 has generally a terminal edge 50 from where there projects a plurality of locking tab arrangements each generally identified by the numeral 52 and each being aligned with an associated arrangement 46.

Figure 4:
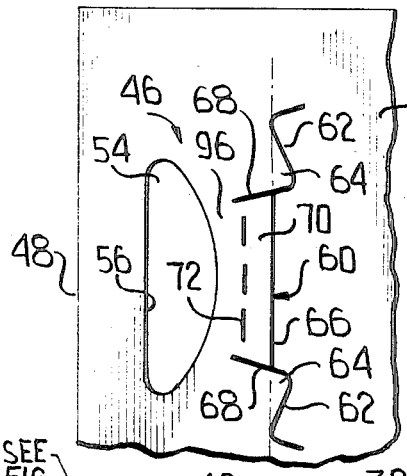
FIG. 4 is an enlarged fragmentary plan view of the corner of the blank of FIG. 3 identified by the reference SEE FIG. 4.

Referring now to FIG. 4, it will be seen that a typical arrangement 46 includes a cutout 54 which is defined by a straight edge 56 which is adjacent the terminal edge 48 and by an arcuate edge 58 which is remote from the terminal edge 48. The straight edge 56 defines a primary locking shoulder.

In alignment with the cutout 54 there is a cut line, generally identified by the numeral 60. The cut line 60 is on the side of the cutout 54 remote from the terminal edge 48. The cut line 60, as shown in FIG. 4, includes a reversely curved portion 62 at each end thereof, the reversely curved portions 62 being generally S-shaped and each defining a secondary locking ear 64 which faces away from the cutout 54. The curved portions 62 of the cut line 60 are joined by a straight portion 66.

It will be seen that at the intersection of the straight portion 66 with each of the curved portions 62 there is a cut line 68 which extends towards the cutout 54 in converging relation.

In the embodiment of FIG. 4, immediately adjacent the straight portion 66 there is a flap 70 defined at its ends by the cut line 68 and being hinged to the panel 40 for resilient bending movement along a bend line 72 which may be of any suitable type, but is illustrated as being of the ruled-perforated type.

Figure 6:
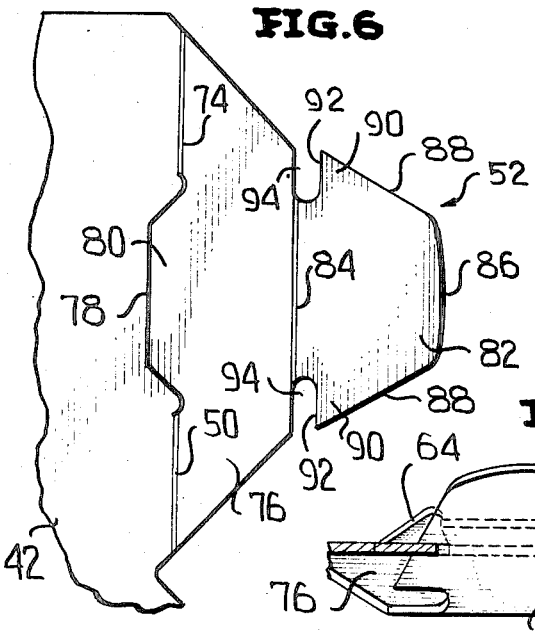
FIG. 6 is an enlarged fragmentary plan view of one corner of the blank of FIG. 3 which is identified by the label SEE FIG. 6.

Referring now to FIG. 6, it will be seen that a typical locking tab arrangement 52 has the terminal edge 50 thereof in part defined by a fold line 74 which hingedly connects to the panel 42 a flap 76. It is to be understood that while each of the locking tab arrangements 52 includes a flap 76, the flap 76 could be continuous along the full length of the panel 42.

For each of the locking tab arrangements 52, the fold line 74 is interrupted by a cut line 78 which defines a primary locking tab 80 which is trapezoidal in outline.

A secondary locking tab 82 is joined to the flap 76 along a fold line 84. While the secondary locking flap 82 may vary in its configuration, it is to be understood that it is to be of a headed configuration so as to include a nose 86, diverging side edges 88 and transversely projecting prongs 90 which terminate in locking shoulders 92 which face, but are spaced from the flap 76. Each locking shoulder 92 is spaced from the flap 76 by a relatively wide notch 94.

Referring once again to FIG. 4, it will be seen that between the cutout 54 and the flap 70, and most particularly the hinge line 72, there is a narrow strap 96 which has a definite function as will be described in detail hereinafter.

Figure 5:
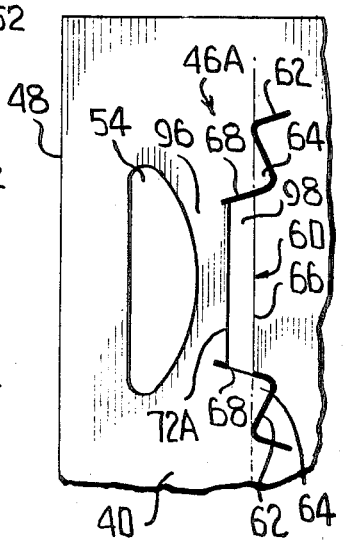
FIG. 5 is an enlarged fragmentary plan view similar to FIG. 4 but wherein the opening means is merely an opening as opposed to a hinged flap.

Reference is next made to FIG. 5 wherein there is illustrated a modified locking tab receiving opening arrangement generally identified by the numeral 46A. This arrangement includes the cutout 54 and the cut line 60. However, in lieu of the flap 70 and the hinge line 72, there is a further cut line 72A with the straight cut line portion 66, the cut line 68 and the cut line 72A defining a second cutout 98. The strap 96 remains unchanged as do the reversely curved cut line portions 62 and the secondary locking ears 64.

Figure 7:
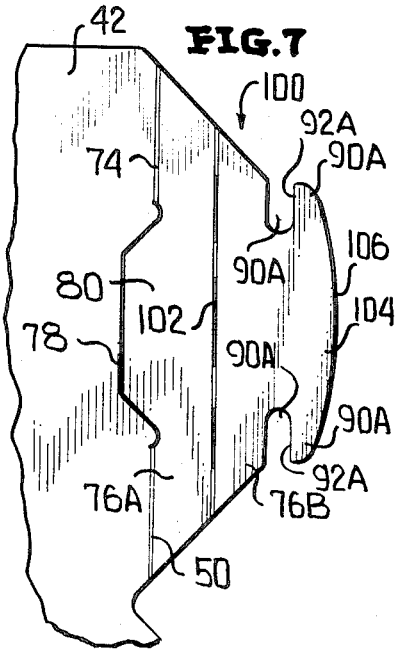
FIG. 7 is a fragmentary plan view similar to FIG. 6 and shows a modified form of secondary locking tab.

Next reference is made to FIG. 7 wherein there is illustrated a modified locking tab arrangement generally identified by the numeral 100 and forming a substitute for the locking tab arrangement 52. The locking tab arrangement 100 employs many of the features of the locking tab arrangement 52 including the fold line 74, the cut line 78 and the primary locking tab 80. It also includes the flap 76 which is foldably connected to the outer closure panel 42 at the terminal edge 50 thereof along the fold line 74. The flap 76, however, is divided into two halves 76A and 76B by a fold line 102 which extends parallel to the fold line 74.

The flap half 76B carries as a planary integral part thereof a secondary locking tab generally identified by the numeral 104. The locking tab 104 is relatively narrow as compared to the locking tab 82 and includes a wide rounded nose 106 defining at its ends prongs 90A which define locking shoulders 92A which are spaced from the flap 76 by notches 94A.

At this time it is pointed out that either of the locking tab arrangements 52, 100 may be utilized in conjunction with either of the locking tab opening arrangements 46, 46A. However, as will be obvious from the following, the secondary locking tab 82 is intended to extend generally at right angles to the inner closure panel 40 while the secondary locking tab 104 is intended to be disposed generally parallel to the inner closure panel 40.

Figure 2:
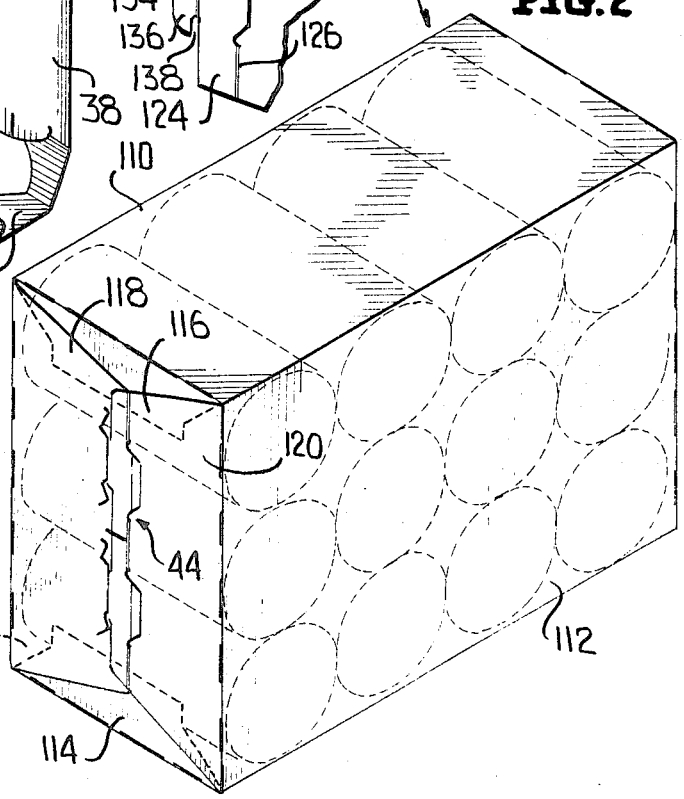
FIG. 2 is a perspective view of a conventional box type carton for holding twelve cans wherein the closure panels are at the end of the carton.

Reference is now made to FIG. 2 wherein there is illustrated another use for the improved lock arrangement which is the subject of this invention. In FIG. 2 there is illustrated a box like carton, generally identified by the numeral 108 which is intended to carry twelve cans or like containers. The carton or box 108 is rectangular in cross section and includes a top panel 110, side panels 112, a bottom panel 114 and end closure panel arrangements 116. Each closure panel arrangement 116 includes an inner closure panel 118 and an outer closure panel 120 which are foldably connected to respective ones of the side walls 112. The closure panels 116, 118 are secured together in overlapping relation utilizing lock arrangements, such as the locking arrangement 44 of FIG. 1. It is to be understood that each locking arrangement 44 may be one of any of a plurality of combinations of locking tab receiving opening arrangements and locking tab arrangements.

Figure 13:
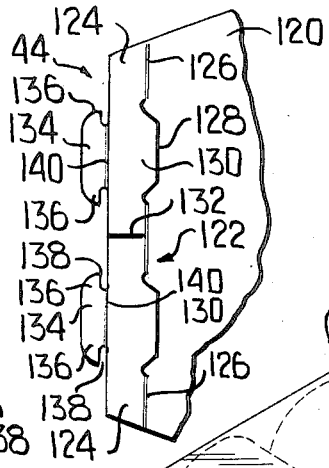
FIG. 13 is a fragmentary plan view of a blank from which the carton of FIG. 2 is formed and shows the locking tab arrangement carried by one of the closure panels.

Reference is now made to FIG. 13 wherein the details of the locking tab arrangement, identified by the numeral 122, which forms part of the locking arrangement 44 are illustrated. The locking tab arrangement 122 includes two sets of locking tabs of which each set includes a flap 124 which is hingedly connected to the closure panel 120 along a fold line 126. The fold line 126 for each flap 124 is interrupted by a cut line 128 which defines from the closure panel 120 as part of the flap 124 a primary locking tab 130.

At this time it is pointed out that the two flaps 124 are separated by a cut line 132. At this time it is to be noted that if desired the cut line 132 could be omitted and the flaps 124 could be of one piece.

Each of the flaps 124 also carries a secondary locking tab 134 which is generally of a T-shaped configuration and has a pair of oppositely projecting prongs 136 which are spaced from the associated flap 124 by notches 138. Each secondary locking tab 134 is connected to its associated flap 124 along a fold line 140.

Figure 8:
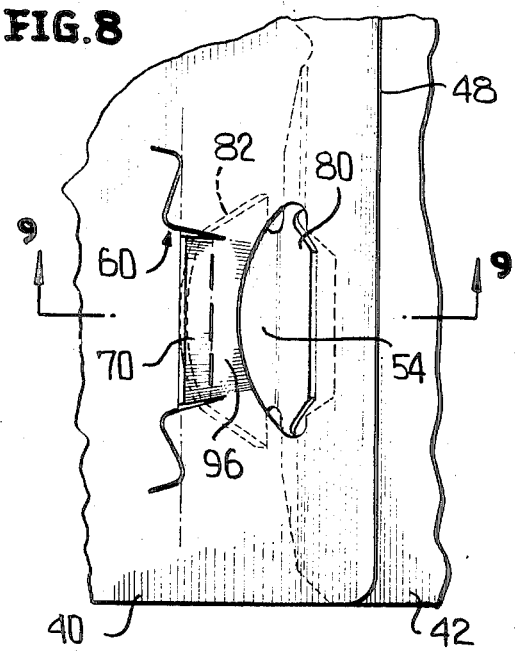
FIG. 8 is a fragmentary plan view of the interior of the bottom of the carton of FIG. 1 after the primary locking tab is engaged and the secondary locking tab is being advanced towards engagement.
Figure 9:
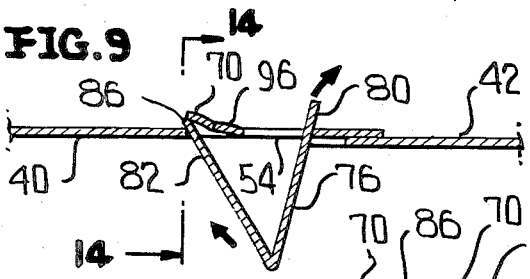
FIG. 9 is a fragmentary vertical sectional view taken generally along the line 9—9 of FIG. 8 and shows further the relationship of the locking tabs with respect to an inner closure panel.

With respect to the combination of the locking tab arrangement 52 and the locking tab receiving opening arrangement 46, it will be seen that there is illustrated in FIGS. 9–12 the basic precepts of the interlocking of these two arrangements. First of all, as is best shown in FIGS. 8 and 9, with the flap 76 folded relative to the outer closure panel 42 and the primary locking tab 80 projecting above the closure panel 42, and with the secondary locking tab 82 folded relative to the flap 76, the closure panel 42 is brought up beneath the closure panel 40 and the primary locking tab 80 automatically enters into the cutout and takes a position immediately adjacent the primary locking shoulder 56. Thereafter, the flap 76 and the secondary locking tab 82 are folded as a unit about the fold line 74 with the nose 86 of the secondary locking tab 82 engaging the flap 70.

Figure 14:
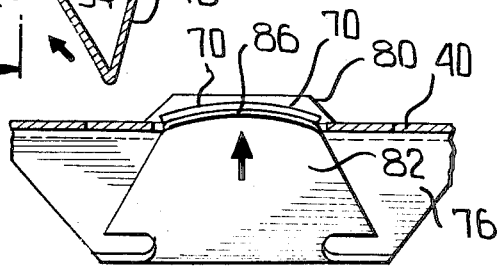
FIG. 14 is a sectional view taken generally along the line 14—14 of FIG. 9 and shows the bowing of the inner closure panel in response to engagement of the secondary locking tab therewith.

As is best illustrated in FIG. 14, when the nose 86 of the secondary locking tab 82 engages the inner closure panel 40, it engages the flap 70. While the flap 70 is hingedly connected to the closure panel 40 along the hinged line 72, it has a resistance to bending or hinging. In view of this, and in view of the narrowness of the strap 96, the panel 40 generally between the cut line straight portion 66 and the cutout 54 has a tendency to bow upwardly as is clearly shown in FIG. 14 and also illustrated generally in FIG. 9. This upward bowing of the panel 40 results in the cut line straight portion 66 opening to receive the nose 86 as the nose 86 slides across the flap 70. It is thus possible to pass the nose 86 through what is initially a cut line even though the carton is formed of a relatively low caliber paper board without the secondary locking tab 82 folding or collapsing.

Figure 15:
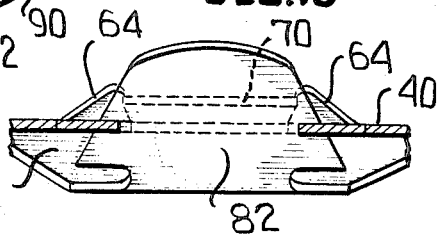
FIG. 15 is a fragmentary sectional view taken generally along the line 15—15 of FIG. 10 and shows the relationship of the secondary locking tab with respect to the inner closure panel after it has partially passed therethrough.
Figure 10:
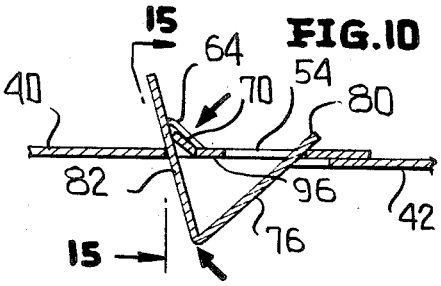
FIG. 10 is a fragmentary sectional view similar to FIG. 9 and shows the secondary locking tab as it advances through the inner closure panel.

As the secondary locking tab 82 passes through the inner closure panel 40 along the cut line 60, as is best shown in FIGS. 10 and 15, the bending of the flap 70 increases and the secondary locking tab 82 engages the secondary locking ears 64 so as to bend them slightly upwardly as is clearly shown in FIG. 15.

Continued movement of the locking tab 82 through the inner closure panel 40 along the cut line 60 results in the prongs 90 clearing the locking ears 64 with the result that the locking ears 64 snap back into the plane of the closure panel 40. At the same time the resiliency of the flap 70 and its resistance to bending out of the plane of the closure panel 40 results in the gentle seating of the flap 70 against the upstanding secondary locking tab 82 to assure the engagement of the prongs 90 over the locking ears 64.

At this time it is pointed out that in the case of the carton 30, the secondary locking tabs 82 will extend up between two side-by-side ones of the bottles to also function as a separator between transversely adjacent pairs of bottles or like containers. It is also feasible to so space the locking arrangements 44 so as to be located between four adjacent containers within a carton.

Reference is now made to FIGS. 16 and 17 wherein the locking tab arrangement 52 is being interlocked with the locking tab receiving opening arrangement 46A of FIG. 5. It is to be understood that due to the width of the secondary locking tab 82, although the nose 86 will begin to enter into the opening 98, it will engage the side edges of the opening 98 and effect a gentle transverse bowing of the closure panel 40 particularly in the area of the narrow strap 96. This will result in a slight opening of the panel 40 along the cut line 60 facilitating the entry of the secondary locking tab 82 through the closure panel 40 along the cut line 60.

As the secondary locking tab 82 passes through the closure panel 40 along the cut line 60, it slightly lifts the locking ear 64 as is shown in FIGS. 16 and 17. Further movement of the secondary locking tab 82 through the closure panel 40 results in a final position such as is shown in FIG. 11.

In FIG. 18 there is illustrated the locking tab arrangement 100 associated with the arrangement 46. It is to be understood that when the nose 106 of the secondary locking tab 104 engages the flap 70, there will be an initial upward bowing of the flap 70 and the strap 96 in the manner generally shown in FIG. 9. As an opening develops in the closure panel 40 along the cut line 60, the nose 106 will enter into that opening and pass through the closure panel 40 along the cut line 60. It will, however, be noted that because the flap 76 is divided into two halves, the secondary locking tab 104 engages the closure panel 40 at a very shallow angle as compared to the sharp angle engagement of the secondary locking tab 82 as is shown in FIGS. 9 and 10. Further, as the flap halves 76A, 76B hinge relative to each other, this angle becomes more shallow and the secondary locking tab 104 moves generally parallel to the inner surface of the closure panel 40 until the prongs 90A thereof lock behind the locking ears 64. It is to be understood that the lock arrangement shown specifically in FIG. 18 can be utilized in conjunction with packages wherein articles packed within the carton will overlie the secondary locking flaps 104.

While the locking tab arrangement 100 has only been illustrated with respect to the locking tab receiving opening arrangement 46, it may be utilized equally as well with the arrangement 46A.

Figure 11:
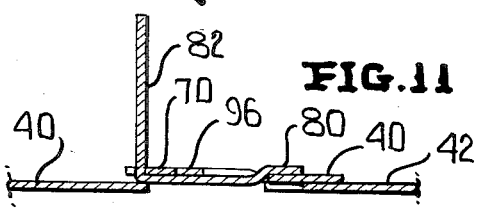
FIG. 11 is another fragmentary sectional view similar to FIG. 9 but with the secondary locking tab having been fully advanced through the inner closure panel and being maintained in position by the resiliently hinged flap which defines the opening means.
Figure 12:
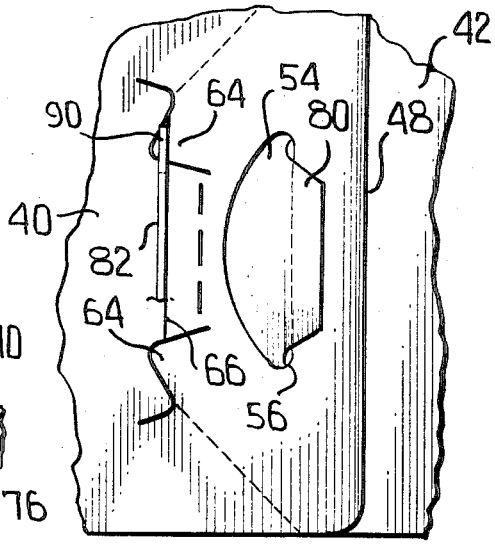
FIG. 12 is a plan view similar to FIG. 8 showing the locked together closure panels of the carton of FIG. 1.

With respect to the locking tab arrangement 122, while the secondary locking tabs 134 are different from the secondary locking tabs 82 of the locking tab arrangement 52, it is to be understood that in the forming of the lock between the closure panels 118, 120, the secondary locking tabs 134 will project generally normal to the plane of the closure panel 118 generally in the manner shown with the locking arrangement of FIG. 11. It is to be understood that there is sufficient space between adjacents cans for the secondary locking tabs 134 to assume this projecting relationship.

Reference is now made to the embodiment of FIGS. 19–23. Reference is first made to the locking tab arrangement of FIG. 20 which is generally identified by the numeral 150 and is carried by a closure panel 152. It is to be understood that a number of the locking tab arrangements 150 may be distributed along the edge of the panel 152.

Each locking tab arrangement 150 includes a flap 154 which is connected to the terminal edge of the panel 152 along a fold line 156. The fold line 156 is interrupted by a cut 158 which defines a primary locking tab 160 which corresponds generally to the locking tab 80. The flap 154 carries along a fold line 162 a secondary locking tab 164. The secondary locking tab 164 is similar to the locking tab 82 except that it is provided with but a single prong 166 and the prong 166 is more pronounced than the prongs 90. The single prong 166 is spaced from the flap 154 by a notch 168.

In FIG. 19 there is illustrated a second panel 170 of a carton blank of which the panel 152 is a part. The panel 170 is also a closure panel and has incorporated therein a locking tab receiving opening arrangement generally identified by the numeral 172. The closure panel 170 has a terminal edge 174 and formed in the closure panel 170 in spaced adjacent relation to the terminal edge 174 is a cutout 176. The cutout 176 corresponds to the cutout 54 and defines a primary locking shoulder 178.

There is formed in the panel 170 as part of the arrangement 172 a cut line 180. The cut line 180 includes a reversely curved portion 182 which is generally S-shaped in outline and which forms an extension of a straight line portion 184. In addition, the cut line 180 includes converging cut lines 186, 188 at opposite ends of the straight portion 184.

In the illustrated embodiment of FIG. 19, a bend line 190, corresponding to the bend line 72, extends between the cut lines 186, 188. Thus there is defined between the bend line and the cut line straight portion 184 a flap 192.

It will be seen that the reversely curved portion 182, in conjunction with the straight cut line 186 defines a locking ear 194. The locking ear 194 cooperates with the prong 166.

At this time it is pointed out that the closure panel 170 also has a strap 196 disposed between the cutout 176 and the hinge line 190. Thus when the nose of the secondary locking tab 164 engages the panel 170 in the area of the flap 192, as is shown in FIG. 22, there will be a transverse bowing of both the flap 192 and the strap 196 in the same manner as is generally illustrated in FIGS. 8, 9 and 14.

Continued movement of the secondary locking tab 164 through the closure panel 170 will result in the secondary locking ear 194 being temporarily displaced followed by the complete passage of the secondary locking tab 164 through the closure panel 170 and the locking of the prong 166 behind the secondary locking ear 194.

At this time reference is made to FIG. 21 wherein there are shown further details of a typical panel 152 having a plurality of locking tab arrangements 150. It will be seen that the two locking tab arrangements 150 differ from one another in that it may be said that the illustrated secondary locking tab 164 of FIG. 20 is a right-hand locking tab whereas the second secondary locking tab 164A is a left-hand secondary locking tab.

It is also to be understood that the cut line arrangement 180 would be reversed in the closure panel 170 for association with the secondary locking tab 164A so as to be of a left-hand arrangement as compared to the right-hand arrangement of FIG. 19.

It is further pointed out here that in accordance with the disclosures of other figures of this application, the flap 192 could be omitted and there merely be an opening as is shown in FIG. 5. Further, the secondary locking tab may be of the type shown in FIG. 7.

Although only several preferred embodiments of the locking arrangement have been specifically illustrated and described herein, it is to be understood that minor variations may be made in the lock arrangements without departing from the spirit and scope of the invention as defined by the appended claims.

We claim:

1. A lock arrangement for lockingly connecting together two closure panels and the like, said lock arrangement comprising a first panel having a first terminal edge and a second panel having a second terminal edge, said first panel having therein a cutout with a portion thereof spaced from and facing said first terminal edge defining a primary locking shoulder, said first panel also having therein adjacent said cutout on the side of said cutout remote from said first terminal edge a cut line including a curved portion defining a secondary locking ear facing away from said cutout and a generally straight portion for receiving a secondary locking tab, and said first panel having adjacent said generally straight cut line portion on the side of said cut line facing said cutout opening means for defining an opening in said first panel for facilitating entry of a nose of a secondary locking tab through said first panel along said cut line, and at least one primary locking tab and at least one secondary locking tab carried by said second panel.

2. A lock arrangement according to claim 1 wherein said curved portion is generally S-shaped and has an axis disposed generally parallel to said generally straight portion.

3. A lock arrangement according to claim 2 wherein there is an intersection between said curved portion and said generally straight portion, and a further cut line extends towards said cutout from said intersection and defines at least a portion of said opening means.

4. A lock arrangement according to claim 1 wherein there is an intersection between said curved portion and said generally straight portion, and a further cut line extends towards said cutout from said intersection and defines at least a portion of said opening means.

5. A lock arrangement according to claim 1 wherein said opening means is in the form of a flap hinged to said first panel along a hinge line positioned between said cut line and said cutout with said flap facing said straight portion.

6. A lock arrangement according to claim 5 wherein said hinge line is disposed in generally parallel relation to said primary locking shoulder, and the spacing between said hinge line and said cutout defining a narrow strap-like portion subject to arching as said secondary locking tab begins to enter into said opening.

7. A lock arrangement according to claim 5 wherein said flap forms means for forcing said secondary tab into overlapping relation to said locking ear.

8. A lock arrangement according to claim 1 wherein said opening means is in the form of a second cutout extending from said cut line towards the first mentioned cutout, said second cutout being aligned with said cut line straight portion.

9. A lock arrangement according to claim 8 wherein said second cutout has a boundary disposed adjacent said first cutout, and the spacing between said cutouts defining a narrow strap-like portion subject to arching as a secondary locking tab begins to enter into said opening.

10. A lock arrangement according to claim 1 wherein said primary and secondary locking tabs are carried by a flap hingedly connected to said second panel terminal edge, said primary locking tab is formed from said second panel and rigid with said flap, and said secondary locking tab is hingedly carried by said flap and faces in the opposite direction from said primary locking tab, and said secondary locking tab has a transversely projecting prong receivable through said first panel along said cut line curved portion and lockable behind said secondary locking ear.

11. A lock arrangement according to claim 10 wherein said secondary locking tab when projecting through said cut line extends generally at right angles to said first panel.

12. A lock arrangement according to claim 10 wherein said secondary locking tab when projecting through said cut line extends generally parallel to said first panel.

13. A lock arrangement according to claim 10 wherein said secondary locking tab when projecting through said cut line extends generally at right angles to said first panel and forms separator means.

14. A lock arrangement according to claim 1 wherein said cut line has a second curved portion defining a second secondary locking ear at the opposite end of said straight portion.

15. A lock arrangement according to claim 10 wherein said cut line has a second curved portion defining a second secondary locking ear at the opposite end of said straight portion, and said secondary locking tab has a second transversely projecting prong projecting from the opposite side thereof and lockable behind said second secondary ear.

16. A lock arrangement according to claim 1 wherein said secondary locking tab when projecting through said cut line extends generally parallel to said first panel.

17. A lock arrangement according to claim 1 wherein said first terminal panel has a hinged edge remote from said first terminal edge, and said cut line is remote from said hinged edge.

18. A lock arrangement according to claim 17 wherein said secondary locking tab when projecting through said cut line extends generally parallel to said first panel.

19. A method of lockingly connecting together two closure panels, said method comprising the steps of providing a first panel having a first terminal edge and a second panel having a second terminal edge, forming in said first panel in spaced relation to said first terminal edge a cutout having a boundary thereof closest to said first panel terminal edge defining a primary locking shoulder, forming in said first panel in spaced adjacent relation to said cutout and remote from said first terminal edge a cut line including a curved portion defining a locking ear facing away from said cutout and a generally straight portion, forming in said first panel adjacent said straight portion and between said straight portion and said cutout opening means for defining in said first panel an opening, providing said second panel along said second terminal edge with locking tab means for interlocking with said first panel, said locking tab means including oppositely facing primary and secondary locking tabs, said secondary locking tab having a free nose and a transversely projecting prong, bringing said first and second terminal edge portions into overlapping relation while folding said locking tab means relative to said second panel and inserting said primary locking tab into said cutout behind said primary locking shoulder, and then with said secondary locking tab folded relative to said primary locking tab engaging said second locking tab nose with said opening means and deforming said first panel to effect the opening of said first panel along said cut line to facilitate entry of said secondary locking tab nose into said cut line followed by the passage of said secondary locking tab through said first panel along said cut line and locking of said prong behind said locking ear.

20. A method according to claim 19 wherein in the forming of said cutout and said opening means there is defined between said cutout and said opening means a narrow strap, and the deforming of said first panel includes a general arching of said narrow strap.

21. A method according to claim 19 wherein said opening means are formed as a flap in part defined by said cut line straight portion and being connected to said first panel along a hinge line parallel to said straight portion.

22. A method according to claim 21 wherein said secondary locking tab after passing through said first panel projects beyond said first panel generally at right angles to said first panel, and said flap resiliently engages said secondary locking tab and assures engagement of said prong behind said locking ear.

23. A method according to claim 19 wherein said secondary locking tab after passing through said first panel extends generally parallel to said first panel.

* * * * *